United States Patent [19]

Kicherer

[11] 3,930,920

[45] Jan. 6, 1976

[54] PROCESS OF MANUFACTURING TENNIS RACKET FRAMES OR THE LIKE

[75] Inventor: Karl Heinz Kicherer, Nurtingen, Germany

[73] Assignee: Modicus Karl-Heinz Kicherer, Nurtingen, Wurttemberg, Germany

[22] Filed: Feb. 14, 1975

[21] Appl. No.: 550,131

Related U.S. Application Data

[63] Continuation-in-part of Ser. No. 305,586, Nov. 10, 1972, abandoned.

[30] Foreign Application Priority Data

June 20, 1972 Germany ..... 2229920

[52] U.S. Cl. ..... 156/156; 156/191; 156/194; 156/228; 273/73 F

[51] Int. Cl.[2] ..... B65C 3/26

[58] Field of Search ..... 156/156, 184, 187, 191, 156/194, 228, 185, 213, 215, 285; 264/250, 254; 273/73 C, 73 F, 73 G

[56] References Cited

UNITED STATES PATENTS

| | | | |
|---|---|---|---|
| 2,593,714 | 4/1952 | Robinson | 156/156 |
| 2,878,020 | 3/1959 | Robinson | 273/73 F |
| 3,256,125 | 6/1966 | Tyler | 156/228 X |
| 3,755,037 | 8/1973 | Erwin et al. | 273/73 F X |

FOREIGN PATENTS OR APPLICATIONS

| | | | |
|---|---|---|---|
| 848,826 | 8/1970 | Canada | 273/73 F |
| 1,122,895 | 8/1968 | United Kingdom | 273/73 F |
| 2,130,663 | 2/1972 | Germany | 273/73 F |

*Primary Examiner*—Douglas J. Drummond
*Assistant Examiner*—David A. Simmons
*Attorney, Agent, or Firm*—Haseltine, Lake & Waters

[57] ABSTRACT

A process for manufacturing tennis racket frames including lining the contoured mold cavities of a mold with layers of predetermined oriented plastic strip material, encompassing elastic inflatable tubes in said mold cavities with superimposed layers or applications of unidirectionally and diagonally oriented prepreg material, positioning the tubes in the mold halves, inserting a hard foam member in the mold cavities in space bounded by each of the tubes, folding the first layers of prepreg material over the hard foam member, closing the mold halves, and polymerizing the prepreg material layers under heat and pressure so as to form a molded tennis racket frame.

6 Claims, 7 Drawing Figures

PROCESS OF MANUFACTURING TENNIS RACKET FRAMES OR THE LIKE

FIELD OF THE INVENTION

The present invention relates to a process for the manufacture of tennis racket frames or the like. This application is a continuation-in-part application of Ser. No 305,586; filed Nov. 10, 1972, now abandoned.

In particular, the invention relates to a process of manufacturing tennis racket frames, or rackets for other ball games which are formed of a fiber-reinforced plastic material. The process essentially consists of positioning the plastic material about an elastic, gas-impervious and heat resistant tube which is located in recesses of predetermined contour within a pair of complementary mold halves, and wherein the plastic material is then hardened through the application of suitable pressure and heat. Inserts are positioned in the mold so as to form apertures in the formed racket frame for racket strings, and the tube, after closing of the mold halves, is maintained under pressure during the hardening process of the plastic material, and subsequently after the hardening is completed, is pulled out of the finished formed racket frame.

DISCUSSION OF THE PRIOR ART

A process for the manufacture of tennis rackets is disclosed in German Published Patent Application 2,130,663 (French Pat. No. 2,098,838), in which a molding form is utilized which has a hollow interior of generally rectangular cross-sectional configuration. Expandable covers or envelopes and contiguously interlaced, stranded woven and webbed supported bands of glass fiber material are drawn onto a pair of semi-rigid ring shaped cores. The strand-forming fibers cross each other at approximately right angles so as to form, relative to the longitudinal axis, an angle of approximately 45°. The thereby formulated double profile is then encompassed with a further band fiber material, the entire structure impregnated with a polymerized plastic material, and then positioned in the mold form. In the interior and gripping regions of the racket being formed, a further similar double profile is concurrently provided during the formation of the racket in order to provide a reinforced construction. Upon expansion or blowing up of the covers or envelopes, the woven fiber material bands are shaped so as to conform in their contour to the interior surfaces of the mold form. Polymerization of the plastic material is then carried out and, subsequently, both ring-shaped cores may then be removed. A drawback of this prior art process lies in that, in order to effect the positioning of the racket-forming material layers with respect to each other and relative to the mold form, there are required two of the ring-shaped profile cores, thereby requiring an additional finishing operation for the rackets. Furthermore, the apparent subsequently required boring of the formed racket frame so as to provide stringing apertures for the racket strings has the disadvantage in that it damages the glass fibers, and as a result reducing the strength of the racket frame.

In French Pat. No. 1,473,356, there is further disclosed a process for the manufacture of tennis rackets, which utilizes as the constructional base material, a tube which is constructed of woven flexible glass fibers. The tube is immersed in a polymerizable plastic material within a suitable mold form, in which rods are located and fastened, prior to the polymerization of the material, so as to define the apertures in the frame for mounting the racket strings. The drawback of this process lies in the closed and cross-sectionally invariable form of the tube material, so as to exclude a varied distribution of the plastic material encompassing the tube for the purpose of imparting a predetermined weight distribution definition to the racket frame. Additionally, this construction fails to consider the requirements of the shear and bending strengths of the racket frames during use of the latter.

Finally, a racket frame produced by a similar-type process, is disclosed in German Published Application No. 1,942,082. However, this generally utilized racket frame, in its construction gives insufficient consideration to the conditions of bending and shearing forces occurring under actual playing conditions.

SUMMARY OF THE INVENTION

Accordingly, it is an object of the present invention to provide an improvement in a generally known process for the manufacture of tennis racket frames which are formed of a fiber reinforced plastic material so as to particularly extensively enhance the life expectancy of the racket frame. In connection with the foregoing, the present invention ameliorates the drawbacks and provides a novel solution to the problems encountered in the prior art processes, by locating in the interior central portion of a pair of complementary, cooperative mold halves for racket frames, a prepreg (preimpregnated plastic material) layer extending about the inner mold cavity edges thereof, and in which on the inner edge of the central portion there is further provided a strip of uni-directionally oriented prepreg material. This prepreg material, which is widely known and employed in the plastics industry, is described in greater detail hereinbelow with particular application to the present invention. An elastic tube is then subsequently positioned in each mold half cavity, and about which each tube there is positioned a strip of the uni-directionally oriented prepreg material and a further prepreg strip having a diagonal fiber orientation. Furthermore, the free region in the interior central portion of each mold form half which is bordered by the tube is then filled with a hard foam member and, finally, the portions of the prepreg material extending beyond the inner edge of the mold is then wound about the hard foamed member. In view of the requirements for elasticity of the tennis racket frame during use, particular care must be imparted to the structuring of the utilized plastic material. Thus, the diagonally oriented outer layer or layers are adapted to absorb the generated shearing forces, and the contiguous or adjacent uni-directionally oriented layers to absorb bending loads or forces generated in the racket frame.

A particular advantage may be further obtained by use of the invention, in that the elastic or inflatable tubes or, respectively, predetermined portions thereof, may be encompassed by the diverse prepreg material layers, which may also be of various thicknesses so as to extend in a better weight-wise distribution within the frame grip, so as to thereby facilitate a differentiating weight definition of the racket frame.

A further advantageous construction of the racket frame contemplates in that the edges of the uni-directionally oriented prepreg material strips, in their position located about the tube, are either contiguous or in close proximity to each other, whereas the edges of the diagonally oriented prepreg strips overlap. It is also advantageous that within the free interior region or space of the central portions of each of the form halves, each filled by a hard foam member, the latter are covered on at least one side thereof with a foamable adhesive film. Since the prepreg material layers are not inherently wear-resistant, in accordance with a further feature of the invention, a particularly advantageous construction of the racket frame includes a profiled edge reinforcement member for reinforcing or protecting the crown or outer edge of the frame, which is formed of a wear-resistant material. Furthermore, in accordance with the invention, it is also advantageous that the inserts in the molds for producing the stringing apertures in the racket frames are located and shaped so as to form a longitudinal groove along the outer periphery of the frame which extends to the interior frame region.

BRIEF DESCRIPTION OF THE DRAWINGS

Reference may now be had to the following detailed description of an exemplary embodiment of the invention, taken in conjunction with the accompanying drawings, in which corresponding elements as shown in the individual figures are designated with identical reference numerals, and in which.

DETAILED DESCRIPTION

Figure 1:
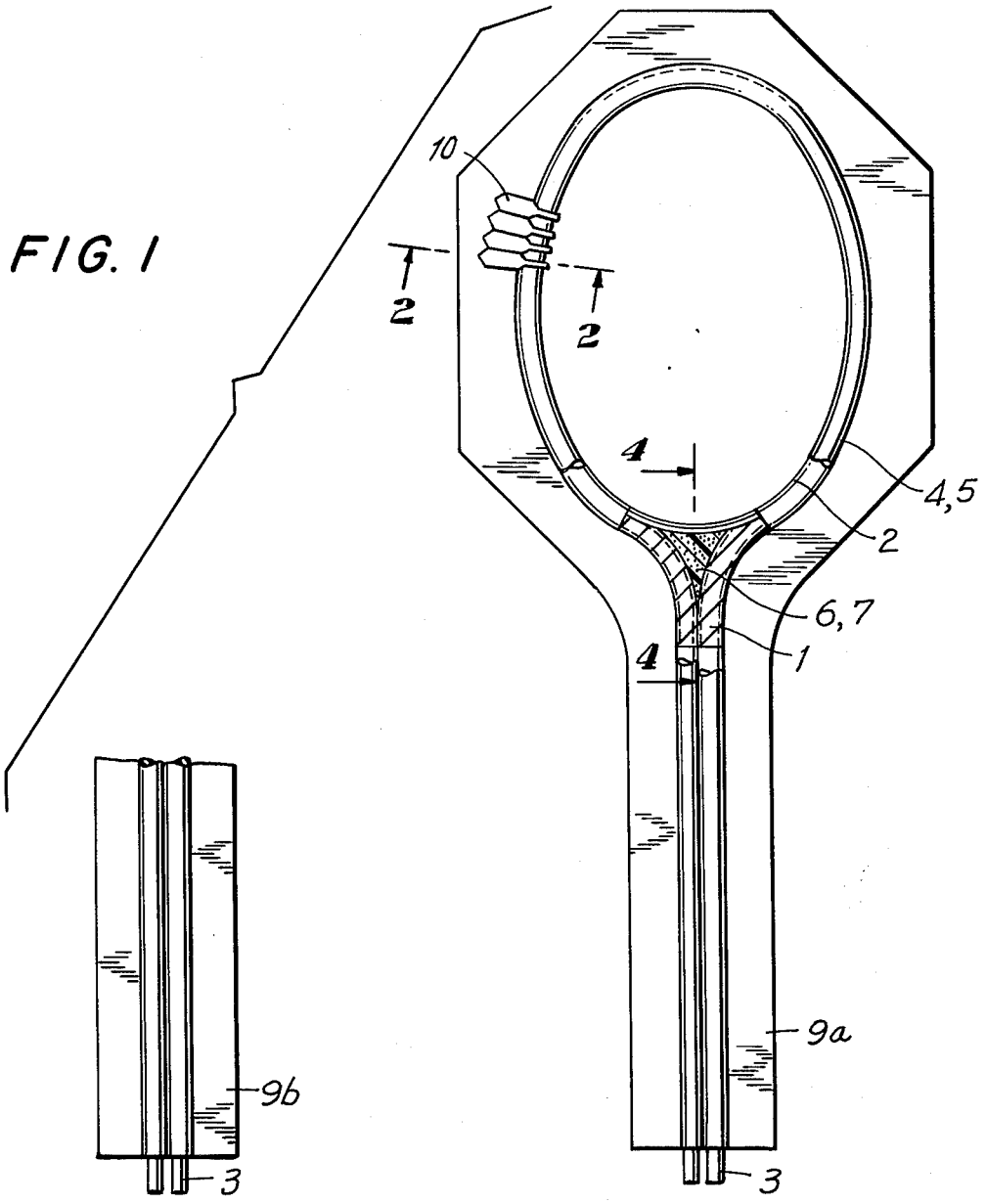
FIG. 1 is a plan view of a racket frame pressing or molding assembly introduced into the molding form half.
Figure 2:
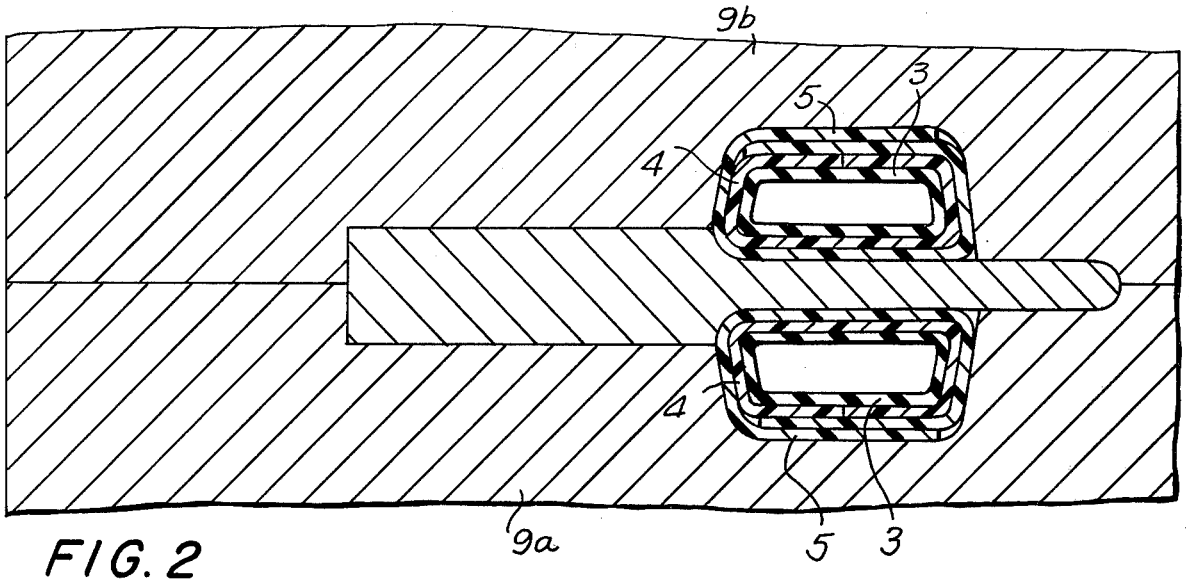
FIG. 2 shows a sectional view, on an enlarged scale, taken along line 2—2 in FIG. 1.
Figure 4:
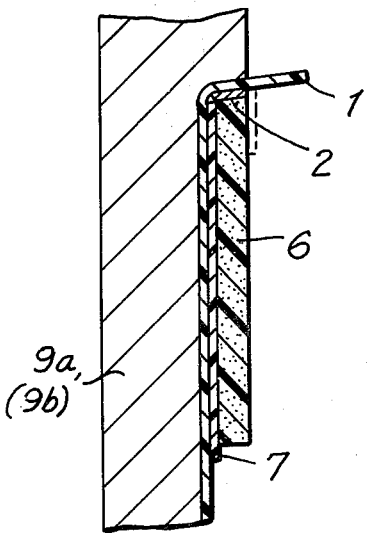
FIG. 4 is a sectional view, on an enlarged scale, taken along line 4—4 in FIG. 1.
Figure 5:
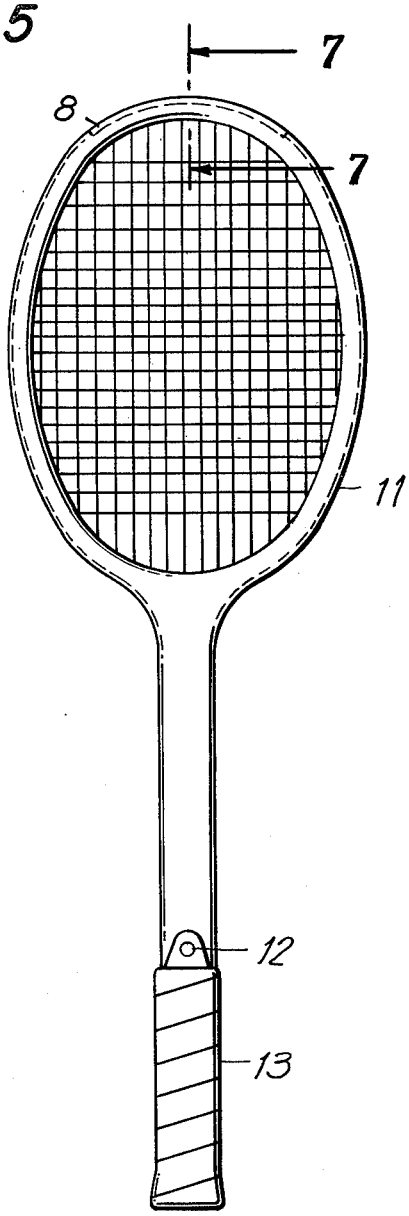
FIG. 5 is an elevational front view of a completed tennis racket manufactured in accordance with the process of the present invention.
Figure 6:
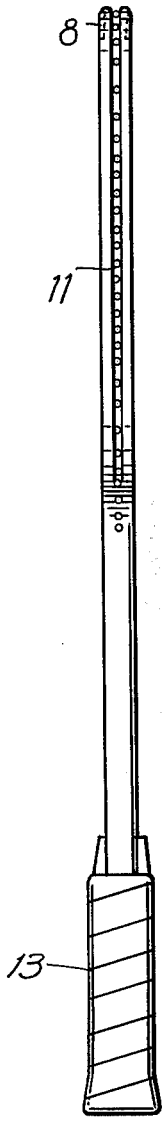
FIG. 6 is a side elevational view of the tennis racket of FIG. 5.
Figure 7:
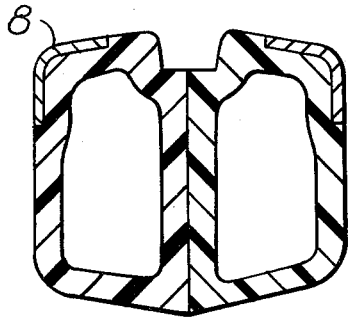
FIG. 7 is a sectional view, on an enlarged scale, taken along line 7—7 in FIG. 5.

Referring now in detail to the drawing, a preimpregnated plastic material layer 1 constituted of the so-called commercially available "Prepreg" material and hereinafter referred to as prepreg, is positioned along the hollow interior contour so as to extend beyond the inner edges of the oval recesses of a pair of complementary tennis racket frame molding form halves 9A and 9B, as shown in FIGS. 1, 2 and 4, in order to provide for the formation of the core or inner portion of a tennis racket, and along the oval contour thereof.

The term "prepreg" is derived from the Anglo-Saxon terminology as an abbreviation of the phrase "preimpregnated material", and is commonly employed in the United States and foreign plastics industries. The preimpregnated or prepreg material usually is formed flat-shaped and, employed in the construction of a tennis racket frame, consists of a glass fiber filament or web of the so-called "atlas" type which is impregnated with an epoxy resin formulation, and is then provided with a finish determined by the resin. The last mentioned finishing is the treatment of the individual basic glass fibers so as to attain good adherence. The impregnation is carried out at a predetermined temperature in an automatically operating installation known in the plastics technology, wherein the type and amount of epoxy resin formulation is determined with respect to the desired modulus of elasticity, impact resistance, water absorption, temperature resistance, the electrical properties based on type and period of utilization, as well as any other required properties of the tennis racket frame. The thus obtained end product, provided on one side thereof with a protective foil which is removable later on, is known in the art as "low pressureprepreg" (NIEDERDRUCK-PREPREG).

Although not necessarily limited thereto, the prepreg material utilized in the construction of the present tennis racket frame is manufactured and sold by applicants in Germany under the registered trademark ELITREX.

A suitable prepreg material used in the construction of the inventive tennis racket frame may have the following approximate preferred ranges of composition and physical properties.

| | |
|---|---|
| Glass fiber filaments and epoxy resin laminate: | 37%–50% resin content |
| Density: | 1.6–1.8 g/cm$^3$ |
| Tensile strength: | 2800–5900 N/mm$^3$ (Newton/mm$^3$) |
| E-modulus (elasticity): | $2.0\times10^4$–$3.3\times10^4$ N/mm$^2$ |
| Coefficient of Linear Expansion: | $11.5\times10^{-6}$–$14.4\times10^{-6}$ cm/cm°C |

Figure 3:
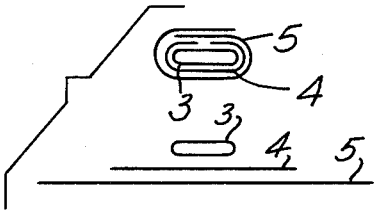
FIG. 3 is a schematic view of an elastic or inflatable tube in a mold utilized in the formation of a racket frame according to the present invention.

Superimposed on the first mentioned prepreg material layer, which is primarily constituted of a uni-directionally oriented prepreg material, or of a prepreg material having diagonally oriented fibers, there is applied at least a second layer 2 of uni-directionally oriented prepreg material. Subsequently, as shown in FIG. 3, in each of both form halves 9A and 9B, there is positioned an elastic, inflatable gasimpervious, heat resistant tube 3, which has been previously similarly encased with prepreg material layers 4 and 5. Of these layers, the first one is composed of a uni-directionally oriented prepreg material. The material strip is positioned about each of the tubes whereby both side edges thereof encompassing tube 3 are located at minimum spaced or contiguous relationship with respect to each other so as to subsequently serve, during the use of the tennis racket, for the absorption of the generated bending loads or forces in the racket frame. About this first layer or application there is positioned a further prepreg material layer or application having diagonally oriented fibers, whose edges are in an overlapping relationship when positioned about tubes 3 and, respectively, the first prepreg material layer 4, so as to be able to later on serve for absorbing the shearing loads or forces generated in the tennis racket frame.

The free space within each of mold form halves 9A and 9B bounded by the tubes 3 which are each encompassed by the winding of the prepreg material layers or applications 4 and 5, due to reasons of stability, is now completely filled with a hard foam material member 6 which is, preferably, covered on at least one side thereof with a foamable adhesive film 7. Subsequently, the previously mentioned prepreg material layer or application 1, which extends beyond the interior portion, is folded about the hard foam material member 6 in the position illustrated in chaindotted lines in FIG. 4.

When employing the above-mentioned prepreg material in the construction of the inventive tennis racket frame, the material already possesses at a relatively low pressure range of 0.07 to 0.7 N/mm² (Newton per mm²) adequate flow properties so as to permit the molding and shaping thereof. This provides the advantage that the manufacture of complex forms and the molding process may be effected at or close to room temperatures. The hardening or setting of the prepreg material is effected at temperatures with the range of about 120° to 175°C., while the hardening or setting time is within the range of about 30 to 90 minutes.

Thus, inasmuch as the elasticity at room temperature, which is determined by the epoxy resin formulation in the material, is limited to a period of only about 5 to 10 days, low-pressure prepreg materials prior to their use must either be stored at lower temperatures, or quickly processed. In the present tennis racket frame construction, the prepreg material is positioned on a work table with the unprotected side thereof facing downwardly, cut into strips and segments of required dimensions and, after removal of the protective storage foil therefrom, laminated until reaching the desired height. Whereas the basic binder may be ascertained in the epoxy resin, the structural adhesive material for the individual prepreg layers or applications is provided primarily by the resin. Subsequently, the prepreg layers are wound about the elastic, inflatable tube and positioned in the molding form. After closing of the form, the tube is subjected to the previously mentioned internal low pressure of approximately 0.07 N/mm² to thereby assume the shape of the mold cavity.

The aperture or openings in the racket frame for the strings of the tennis racket are obtained, in a generally known manner, and as shown in FIGS. 1 and 2, by locating between the mold form halves 9A and 9B, a plurality of loosely inserted, spaced inserts 10. After insertion of the completed strip material-encased assembled tube 3, 4 and 5, in the illustrated lower form half 9A, the inserts which extend equally into both form halves, are similarly positioned in the lower form half. The portions of the inserts which are embedded into the mold forming material are dimensioned widthwise so as to contact adjacent inserts along those portions. The contacting end portions of the inserts formed of the enlarged width dimensions extend outwardly beyond the mold form material so as to form at the outer periphery of the racket frame a groove 11 extending to the interior of the frame. In another embodiment of the form, there may be provided a profile member 8 constituted of wearresistant material such as, for example, aluminum, nylon or the like, which upon hardening of the inventive molded portions of the racket frame are embedded therein in order to protect the non-wear resistant prepreg material layers, and to thereby impart an extremely long life expectancy to the frame of the tennis racket. Subsequently, the upper form half 9B, in which there previously has been similarly located a prepreg material encompassed tube 3, 4 and 5, is positioned on the lower form half, and is connected to the latter in order to provide a closed mold. Upon suitable heating of the form halves and expansion or inflating of the elastic tubes, polymerization of the plastic material is effected, whereafter the tubes 3 are then pulled out of the finished racket frame. A through-aperture 12 may be previously formed for attachment of a handgrip 13 at the free end of the racket frame or, alternatively, without an undue reduction in the strength of the racket, may be subsequently bored therein.

In summation, through use of the above described inventive molding process, tennis racket frames may be readily manufactured and finished in a relatively simple and economic manner, as required, effortlessly conformed to the various weight classes for tennis rackets and, notwithstanding the comparatively low manufacturing costs, constructed so as to be imbued with an unexpectedly high life expectancy.

While there has been shown what is considered to be the preferred embodiment of the invention, it will be obvious that modifications may be made which come within the scope of the disclosure of the specification.

What I claim is:

1. A process of manufacturing frames for tennis rackets from a fiber-reinforced plastic material in a mold including a pair of complementary mold halves, each said mold half having an internal mold cavity substantially defining the contour of said racket frame, comprising the steps of:

a. positioning a first layer of a plastic impregnated material in each said mold cavity extending beyond the rim of said mold cavity; superimposing a second layer of a uni-directionally oriented plastic strip material on said first layer;

b. encompassing each of a pair of elastic, gas-impervious, heat resistant hollow tubes with a uni-directionally oriented plastic strip material; winding a further layer of a diagonally oriented plastic strip material about said uni-directionally oriented plastic strip material;

c. positioning one said plastic material-encompassed tube within respectively each of said mold half cavities;

d. filling the spaces intermediate said tubes and the surfaces of each of said mold cavities with a hard foam member;

e. folding the portions of said first plastic impregnated material extending beyond said mold cavity rim about said hard foam member; and f. closing said mold halves; heating said mold while concurrently pressurizing said tubes so as to polymerize the plastic material of the layers while conforming to the shape of said mold cavities; and withdrawing said elastic tube from said molded tennis racket frame.

2. A process as claimed in claim 1, said uni-directionally oriented strip material encompassing said hollow tube having the side edges thereof in substantially contiguous relationship, the side edges of successive windings of said diagonally oriented plastic strip material being in overlapping relationship.

3. A process as claimed in claim 1, comprising a foamable adhesive film layer being applied to at least one surface of said hard foam member.

4. A process as claimed in claim 1, comprising embedding wear-resistant profiled means along at least portions of the outer peripheral surface of said racket frame.

5. A process as claimed in claim 1, comprising interposing molding inserts between said mold halves to form apertures for subsequent stringing of said molded racket frame, said inserts having enlarged width dimensions along portions thereof so as to form a continuous inwardly extending groove about the periphery of said molded tennis racket frame.

6. A process as claimed in claim 1, said plastic material comprising a low-pressure prepreg material.

* * * * *